US010219094B2

(12) United States Patent
Donaldson

(10) Patent No.: US 10,219,094 B2
(45) Date of Patent: Feb. 26, 2019

(54) ACOUSTIC DETECTION OF AUDIO SOURCES TO FACILITATE REPRODUCTION OF SPATIAL AUDIO SPACES

(71) Applicant: Thomas Alan Donaldson, London (GB)

(72) Inventor: Thomas Alan Donaldson, London (GB)

( * ) Notice: Subject to any disclaimer, the term of this patent is extended or adjusted under 35 U.S.C. 154(b) by 0 days.

(21) Appl. No.: 13/954,331

(22) Filed: Jul. 30, 2013

(65) Prior Publication Data

US 2015/0036847 A1 Feb. 5, 2015

(51) Int. Cl.
*H04R 25/00* (2006.01)
*H04S 7/00* (2006.01)

(52) U.S. Cl.
CPC ..... *H04S 7/303* (2013.01)

(58) Field of Classification Search
CPC ..... H04S 7/30; H04S 2420/01; H04S 7/302; H04S 2400/15; H04S 7/303; H04S 2400/11
USPC ..... 381/1, 303, 300, 306, 307, 310, 17–18
See application file for complete search history.

(56) References Cited

U.S. PATENT DOCUMENTS

| | | | | |
|---|---|---|---|---|
| 4,608,674 | A | 8/1986 | Guscott | |
| 5,889,843 | A * | 3/1999 | Singer et al. | 379/202.01 |
| 7,016,504 | B1 * | 3/2006 | Shennib | 381/60 |
| 2007/0025555 | A1 * | 2/2007 | Gonai et al. | 381/17 |
| 2007/0078326 | A1 | 4/2007 | Yoshikawa et al. | |
| 2008/0232608 | A1 | 9/2008 | Ullmann | |
| 2011/0018447 | A1 | 6/2011 | Chen et al. | |
| 2012/0001875 | A1 | 1/2012 | Li et al. | |
| 2012/0101610 | A1 | 4/2012 | Ojala et al. | |

(Continued)

FOREIGN PATENT DOCUMENTS

| | | | |
|---|---|---|---|
| WO | 2015017583 | A1 | 2/2015 |
| WO | 2015065553 | A2 | 5/2015 |

OTHER PUBLICATIONS

Weider, Ken, International Searching Authority, Notification of Transmittal of the International Search Report and the Written Opinion of the International Searching Authority, or the Declaration, dated May 20, 2015 for International Patent Application No. PCT/US2014/048971.

(Continued)

*Primary Examiner* — Paul S Kim
*Assistant Examiner* — Norman Yu

(57) ABSTRACT

Embodiments of the invention relate generally to electrical and electronic hardware, computer software, wired and wireless network communications, and wearable computing devices to facilitate production and/or reproduction of a spatial sound field and/or one or more audio spaces. More specifically, disclosed are systems, components and methods to determine acoustically positions of audios sources, such as vocal users, for providing audio spaces and spatial sound field reproduction for remote listeners. In one embodiment, a media device includes a housing, transducers disposed in the housing to emit audible acoustic signals into a region including one or more audio sources, acoustic probe transducers configured to emit ultrasonic signals and acoustic sensors configured to sense received ultrasonic signals reflected from an audio source. A controller can determine a position of the audio source.

18 Claims, 11 Drawing Sheets

(56) References Cited

U.S. PATENT DOCUMENTS

| | | | |
|---|---|---|---|
| 2013/0154930 | A1 | 6/2013 | Xiang et al. |
| 2013/0190625 | A1 | 7/2013 | Shibamoto et al. |

OTHER PUBLICATIONS

Young, Lee W., International Searching Authority, Notification of Transmittal of the International Search Report and the Written Opinion of the International Searching Authority, or the Declaration, dated Dec. 29, 2014 for International Patent Application No. PCT/US2014/048974.

Yu, Norman, Office Action dated Apr. 8, 2015 for U.S. Appl. No. 13/954,367.

Yu, Norman, Office Action dated Sep. 14, 2015 for U.S. Appl. No. 13/954,367.

* cited by examiner

ACOUSTIC DETECTION OF AUDIO SOURCES TO FACILITATE REPRODUCTION OF SPATIAL AUDIO SPACES

CROSS-REFERENCE TO RELATED APPLICATIONS

This application is co-related to U.S. Nonprovisional patent application Ser. No. 13/954,367, filed July 30,2013 , and entitled "Motion Detection of Audio Sources to Facilitate Reproduction of Spatial Audio Spaces," which is herein incorporated by reference in its entirety and for all purposes.

FIELD

Embodiments of the invention relate generally to electrical and electronic hardware, computer software, wired and wireless network communications, and wearable/mobile computing devices configured to facilitate production and/or reproduction of spatial audio and/or one or more audio spaces. More specifically, disclosed are systems, components and methods to acoustically determine positions of audios sources, such as a subset of vocal users, for providing audio spaces and spatial sound field reproduction for remote listeners.

BACKGROUND

Reproduction of a three-dimensional ("3D") sound of a sound field using loudspeakers is vulnerable to perceptible distortion due to, for example, spectral coloration and other sound-related phenomena. Conventional devices and techniques to generate three-dimensional binaural audio have been generally focused on resolving the issues of cross-talk between left-channel audio and right-channel audio. For example, conventional 3D audio techniques, such as ambiophonics, high-order ambisonics ("HOA"), wavefield synthesis ("WFS"), and the like, have been developed to address 3D audio generation. However, some of the traditional approaches are suboptimal. For example, some of the above-described techniques require additions of spectral coloration, the use of a relatively large number of loudspeakers and/or microphones, and other such limitations. While functional, the traditional devices and solutions to reproducing three-dimensional binaural audio are not well-suited for capturing fully the acoustic effects of the environment associated with, for example, a remote sound field.

Accurate reproduction of three-dimensional binaural audio typically requires that a listener be able to perceive the approximate locations of vocal persons located in a remote sound field. For example, if an audio reproduction device is disposed at one end of a long rectangular table at one location, a listener at another location ought to be able to perceive the approximate positions in the sound field through the reproduced audio. However, conventional techniques of determining locations of the vocal persons in the sound field are generally sub-optimal.

One conventional approach, for example, relies on the use of using video and/or image detection of the persons to determine approximate points in space from which vocalized speech originates. There are a variety of drawbacks to using visual information to determine the position of the persons in the sound field. First, image capture devices typically require additional circuitry and resources, as well as power, beyond that required for capturing audio. Thus, the computational resources are used for both video and audio separately, sometime requiring the use of separate, but redundant circuits. Second, the capture of visual information and audio information are asynchronous due to the differing capturing devices and techniques. Therefore, additional resources may be required to synchronize video-related information with audio-related information. Third, image capture devices may not be well-suited for range-finding purposes. Moreover, typical range-finding techniques may have issues as they usually introduce temporal delays, and provide for relatively coarse spatial resolution. In some instances, the introduction of temporal delay can consume power unnecessarily.

FIG. 1 depicts an example of a conventional range-finding technique that introduces temporal delays. Consider that diagram 100 illustrates a current for driving an ultrasonic transducer for purposes of range-finding. As shown, conventional techniques for generating a drive current 102 includes switching, for example, from one signal characteristic to another signal characteristic. This switching introduces a temporal delay 104 as the transducer "rings down" and then "rings up" to the next signal characteristic. Such delays may limit the temporal and/or spatial resolution of this range-finding technique. Further, switching the signal characteristic from one to the next represents lost energy that otherwise may not be consumed.

Thus, what is needed is a solution for audio capture and reproduction devices without the limitations of conventional techniques.

BRIEF DESCRIPTION OF THE DRAWINGS

Various embodiments or examples ("examples") of the invention are disclosed in the following detailed description and the accompanying drawings.

DETAILED DESCRIPTION

Various embodiments or examples may be implemented in numerous ways, including as a system, a process, an apparatus, a user interface, or a series of program instructions on a computer readable medium such as a computer readable storage medium or a computer network where the program instructions are sent over optical, electronic, or wireless communication links. In general, operations of disclosed processes may be performed in an arbitrary order, unless otherwise provided in the claims.

A detailed description of one or more examples is provided below along with accompanying figures. The detailed description is provided in connection with such examples, but is not limited to any particular example. The scope is limited only by the claims and numerous alternatives, modifications, and equivalents are encompassed. Numerous specific details are set forth in the following description in order to provide a thorough understanding. These details are provided for the purpose of example and the described techniques may be practiced according to the claims without some or all of these specific details. For clarity, technical material that is known in the technical fields related to the examples has not been described in detail to avoid unnecessarily obscuring the description.

Figure 1:
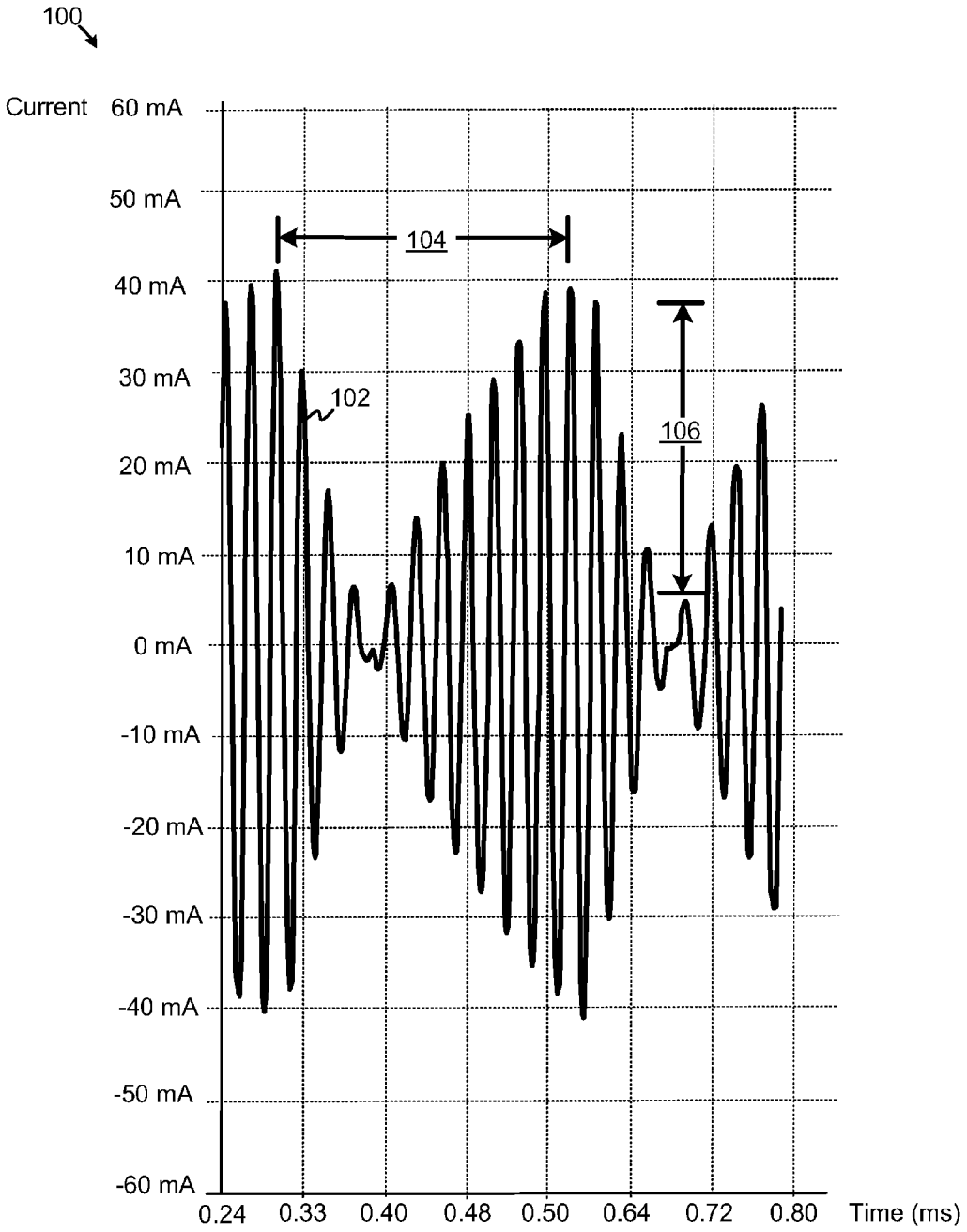
FIG. 1 (Prior Art)
FIG. 1 depicts an example of a conventional range-finding technique that introduces temporal delays.
Figure 2:
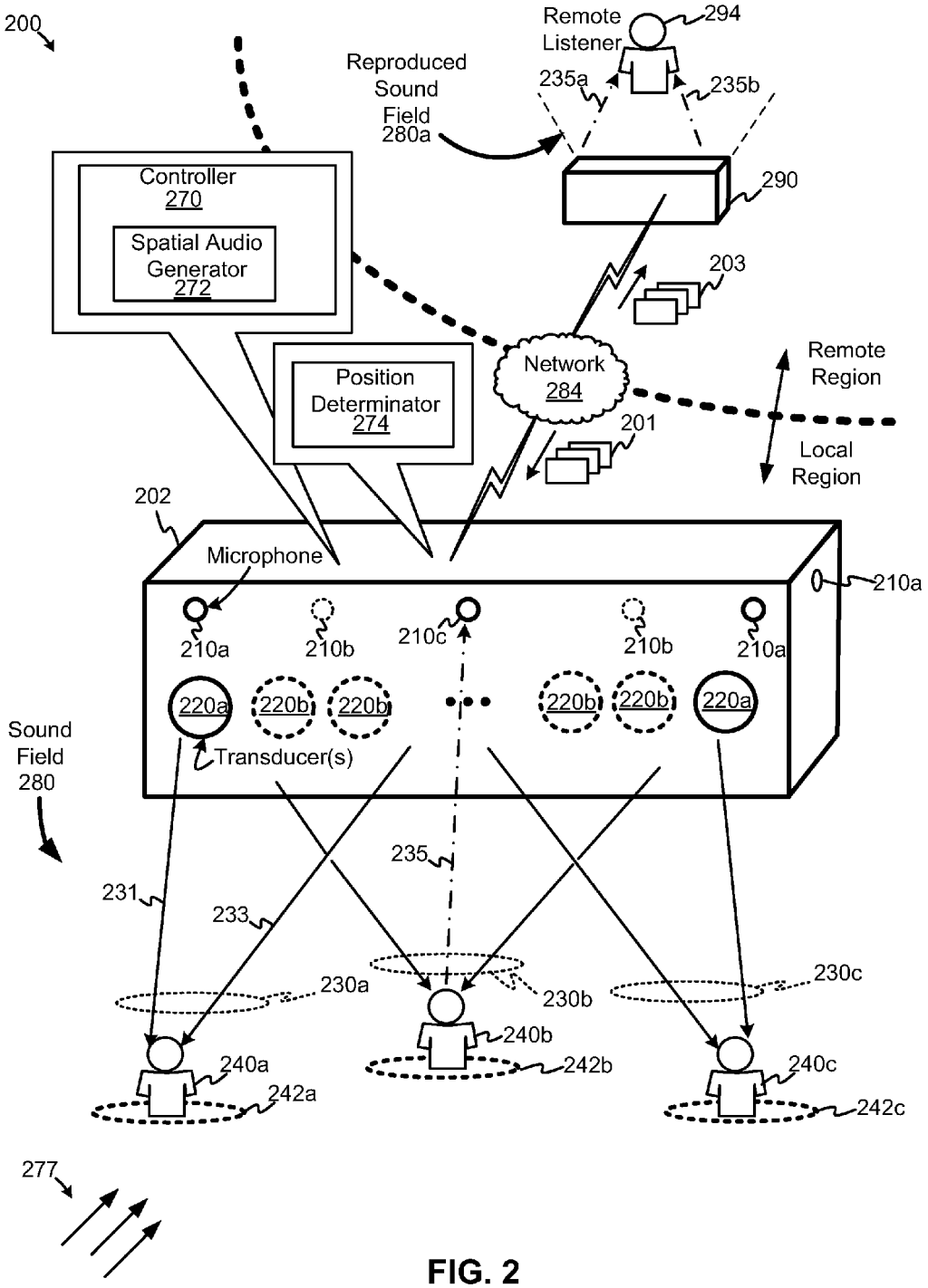
FIG. 2 illustrates an example of a media device configured to facilitate three-dimensional ("3D") audio space generation and/or reproduction, according to some embodiments.

FIG. 2 illustrates an example of a media device configured to facilitate three-dimensional ("3D") audio space generation and/or reproduction, according to some embodiments. Diagram 200 depicts a media device 202 configured to receive audio data (e.g., from a remote source of audio) for presentation to listeners 240*a* to 240*c* as spatial audio. In some examples, at least two transducers operating as loudspeakers can generate acoustic signals that can form an impression or a perception at a listener's ears that sounds are coming from audio sources disposed anywhere in a space (e.g., 2D or 3D space) rather than just from the positions of the loudspeakers. Further, media device 202 can be configured to transmit data representing the acoustic effects associated with sound field 280. According to various embodiments, sound field 280 can be reproduced so a remote listener 294 can perceive the positions of listeners 240*a* to 240*c* relative, for example, to an audio presentation device 290 (or any other reference, such as a point in space that coincides with position of audio presentation device 290) at a remote location.

Diagram 200 illustrates a media device 202 configured to at least include one or more microphones 210, one or more transducers 220, a controller 270, a position determinator 274, and various other components (not shown), such as a communications module for communicating, Wi-Fi signals, Bluetooth® signals, or the like. Media device 202 is configured to receive audio via microphones 210 and to produce audio signals and waveforms to produce sound that can be perceived by one or more listeners 240. As shown in diagram 200, controller 270 includes a spatial audio generator 272. In various embodiments, spatial audio generator 272 is configured to generate 2D or 3D spatial audio locally, such as at audio space 242*a*, audio space 242*b*, and audio space 242*c*, and/or reproduce sound field 280 for presentation to a remote listener 294 as a reproduced sound field 280*a*. Sound field 280, for example, can include one or more audio spaces 242*a* to 242*c* as well as any common regional sounds 277 that can be perceptible as originating at any of audio spaces 242*a* to 242*c*, or as background noise (e.g., sounds of city traffic that are generally detectable at any of the audio spaces in sound field 280).

Spatial audio generator 272 is configured to receive audio, for example, originating from remote listener 294, to generate 2D or 3D spatial audio 230*a* for transmission to listener 240*a*. In some embodiments, transducers 220 can generate a first sound beam 231 and a second sound beam 233 for propagation to the left ear and the right ear, respectively, of listener 240*a*. Therefore, sound beams 231 and 233 are generated to form an audio space 242*a* (e.g., a binaural audio space) in which listener 240*a* perceives the audio as spatial audio 230*a*. According to various embodiments, spatial audio generator 272 can generate spatial audio 230*a* using a subset of spatial audio generation techniques that implement digital signal processors, digital filters, and the like to provide perceptible cues for listener 240*a* to correlate spatial audio 230*a* with a perceived position at which the audio source originates. In some embodiments, spatial audio generator 272 is configured to implement a crosstalk cancellation filter (and corresponding filter parameters), or variant thereof, as disclosed in published international patent application WO2012/036912A1, which describes an approach to producing cross-talk cancellation filters to facilitate three-dimensional binaural audio reproduction. In some examples, spatial audio generator 272 includes one or more digital processors and/or one or more digital filters configured to implement a BACCH® digital filter, which is an audio technology developed by Princeton University of Princeton, N.J.

Transducers 220 cooperate electrically with other components of media device 202, including spatial audio generator 272, to steer or otherwise direct sound beams 231 and 233 to a point in space at which listener 240*a* resides and/or at which audio space 242*a* is to be formed. In some embodiments, transducers 220*a* are sufficient to implement a left loudspeaker and a right loudspeaker to direct sound beam 231 and sound beam 233, respectively, to listener 240*a*. Further, additional transducers 220*b* can be implemented along with transducers 220*a* to form arrays or groups of any number of transducers operable as loudspeakers, whereby groups of transducers need not be aligned in rows and columns and can be arranged and sized differently, according to some embodiments. Transducers 220 can be directed by spatial audio generator 272 to steer or otherwise direct sound beams 231 to specific position or point in space within sound field 280 to form an audio space 242*a* incident with the location of listener 240*a* relative to the location of media device 202. According to various other examples, media device 202 and transducers 220 can be configured to generate spatial audio for any number of audio spaces, such as spatial audio 230*b* and 230*c* directed to form audio space 242*b* and audio space 242*c*, respectively, which include listener 240*b* and listener 240*c*. In some embodiments, spatial audio generator 272 can be configured to generate spatial audio to be perceived at one or more audio spaces 242*a* to 242*c*. For example, remote listener 294 can transmit audio 230*a* directed to only audio space 242*a*, whereby listeners 240*b* and 240*c* cannot perceive audio 230*a* as transducers 220 do not propagate audio 230*a* to audio spaces 242*b* and 242*c*. Note that while listeners 240*a* to 240*c* are described as such (i.e., listeners), such listeners 240*a* to 240*c* each can be audio sources, too.

Position determinator 274 is configured to determine approximate position of one or more listeners 240 and/or one or more audio spaces 242. By determining approximate positions of listeners 240, spatial audio generator 272 can enhance the auditory experience (e.g., perceived spatial audio) of the listeners by adjusting operation of the one or more crosstalk filters and/or by more accurately steering or directing certain sound beams to the respective listeners. In one implementation, position determinator 274 uses information describing the approximate positions at which audio spaces 242 are located within sound field 280 to determine the relative positions of listeners 240. According to some embodiments, such information can be used by generating acoustic probes that are transmitted into sound field 280 from media device 202 to determine relative distances and directions of audio sources and other aspects of sound field 280, including the dimensions of a room and the like. Examples of acoustic probes and other acoustic-based techniques for determining directions and distances of audio spaces are described hereinafter.

In other implementations, position determinator 274 can use audio received from one or more microphones 210 to determine approximate positions at which audio spaces 242 are located within sound field 280. For example, acoustic energy (e.g., vocalized speech) originating from listener 240*a* generally is of greater amplitude received into microphone 210*a*, which is at a relatively shorter distance to listener 240*a*, rather than, for example, the amplitude and time delays associated with the acoustic energy received at microphone 210*c*. Also, data representing vocal patterns (e.g., as "speech fingerprints") can be stored in memory (not shown) to be used to match against those individuals who may be speaking in sound field 280. An individual whose speech patterns match that of the vocal patterns in memory then can be associated with a certain position or audio space. Thus, individualized audio can be transmitted to that person without others in sound field 280 hearing the individualized audio. For example, listener 240*b* can project audio energy 235 toward microphone 210*c*, which is closer to listener 240*b* than other microphones 210*a* and 210*b*. Audio signal amplitude and/or "time of flight" information can be used to approximate a position for listener 240*b*.

In alternate implementations, position determinator 274 can receive position information regarding the position of a listener (or audio source) wearing a wearable device. The wearable device can be configured to determine a location of the wearer and transmit location data to media device 202. An example of a suitable wearable device, or a variant thereof, is described in U.S. patent application Ser. No. 13/454,040, which was filed on Apr. 23, 2012, which is incorporated herein by reference. Also, media device 202 can detect various transmissions of electromagnetic waves (e.g., radio frequency ("RF") signals) to determine the relative direction and/or distance of a listener carrying or using a device having a radio, for example, such as a mobile phone. In some cases, the RF signals can be characterized and matched against RF signal signatures (e.g., stored in memory) to identify specific users or listeners (e.g., for purposes of generating individualized audio). In some examples, one or more image capture devices (e.g., configured to capture one or more images in visible light, thermal RF imaging, etc.) can be used to detect listeners 240*a* to 240*c* for determine a relative position of each listener. In at least one example, media device 202 can provide a variable number of preset audio spaces (e.g., at preset directions, or sectors) that can be generated by spatial audio generator 272. For example, if one listener is selected, transducers 220 direct one or more pairs of sound beams, such sound beams 231 and 233, in a relatively larger audio space in front (e.g., directly in front) of media device, whereas if two listeners are selected, than transducers 220 direct two (2) sets of sound beams into two sectors (e.g., each spanning approximately 90 degrees). Three listeners, such as shown in diagram 200, can be selected to generate audio spaces over three (3) sectors (e.g., each spanning approximately 60 degrees). Any number of positions in sound field 280 can be co-located with audio spaces, whereby spatial audio generator 272 can form the audio spaces based on position data provided by position determinator 274.

Diagram 200 further depicts media device 202 in communication via one or more networks 284 with a remote audio presentation device 290 at a remote region. Controller 270 can be configured to transmit audio data 203 from media device 202 to remote audio system 290. In some embodiments, audio data 203 includes audio as received by one or more microphones 210 and control data that includes information describing how to form a reproduce sound field 280*a*. Remote audio system 290 can use the control data to reproduce sound field 280 by generating sound beams 235*a* and 235*b* for the right ear and left ear, respectively, of remote listener 294. For example, the control data may include parameters to adjust a crosstalk filter, including but not limited to distances from one or more transducers to an approximate point in space in which a listener's ear is disposed, calculated pressure to be sensed at a listener's ear, time delays, filter coefficients, parameters and/or coefficients for one or more transformation matrices, and various other parameters. The remote listener may perceive audio generated by listeners 240*a* to 240*c* as originating from the positions of audio spaces 242*a* to 242*c* relative to, for example, a point in space coinciding with the location of the remote audio system 290. In some cases, remote audio system 290 includes logic, structures and/or functionality similar to that of spatial audio generator 272 of media device 202. But in some cases, remote audio system 290 need not include a spatial audio generator. As such, spatial audio generator 272 can generate spatial audio that can be perceived by remote listener 294 regardless of whether remote audio system 290 includes a spatial audio generator. In particular, remote audio system 290, which can provide binaural audio, can use audio data 203 to produce spatial binaural audio via, for example, sound beams 235*a* and 235*b* without a spatial audio generator, according to some embodiments.

Further, media device 202 can be configured to receive audio data 201 via network 284 from remote audio system 290. Similar to audio data 203, spatial audio generator 272 of media device 202 can generate spatial audio 230*a* to 230*c* by receiving audio from remote audio system 290 and applying control data to reproduce the sound field associated with the remote listener 294 for listeners 240*a* to 240*c*. A spatial audio generator (not shown) disposed in remote audio system 290 can generate the control data, which is transmitted as part of audio data 201. In some cases, the spatial audio generator disposed in remote audio system 290 can generate the spatial audio to be presented to listeners 240*a* to 240*c* regardless of whether media device 202 includes spatial audio generator 272. That is, the spatial audio generator disposed in remote audio system 290 can generate the spatial audio in a manner that the spatial effects can be perceived by a listener 240*a* to 240*c* via any audio presentation system configured to provide binaural audio.

Examples of component or elements of an implementation of media device 200, including those components used to determine proximity of a listener (or audio source), are disclosed in U.S. patent application Ser. No. 13/831,422, entitled "Proximity-Based Control of Media Devices," filed on Mar. 14, 2013 with Attorney Docket No. ALI-229, which is incorporated herein by reference. In various examples, media device 202 is not limited to presenting audio, but rather can present both visual information, including video or other forms of imagery along with (e.g., synchronized with) audio. According to at least some embodiments, the term "audio space" can refer to a two- or three-dimensional space in which sounds can be perceived by a listener as 2D or 3D spatial audio. The term "audio space" can also refer to a two- or three-dimensional space from which audio originates, whereby an audio source can be co-located in the audio space. For example, a listener can perceive spatial audio in an audio space, and that same audio space (or variant thereof) can be associated with audio generated by the listener, such as during a teleconference. The audio space from which the audio originates can be reproduced at a remote location as part of reproduced sound field 280*a*. In some cases, the term "audio space" can be used interchangeably with the term "sweet spot." In at least one non-limiting implementation, the size of the sweet spot can range from two to four feet in diameter, whereby a listener can vary its position (i.e., the position of the head and/or ears) and maintain perception of spatial audio. Various examples of microphones that can be implemented as microphones 210*a* to 210*c* include directional microphones, omni-directional microphones, cardioid microphones, Blumlein microphones, ORTF stereo microphones, and other types of microphones or microphone systems.

Figure 3:
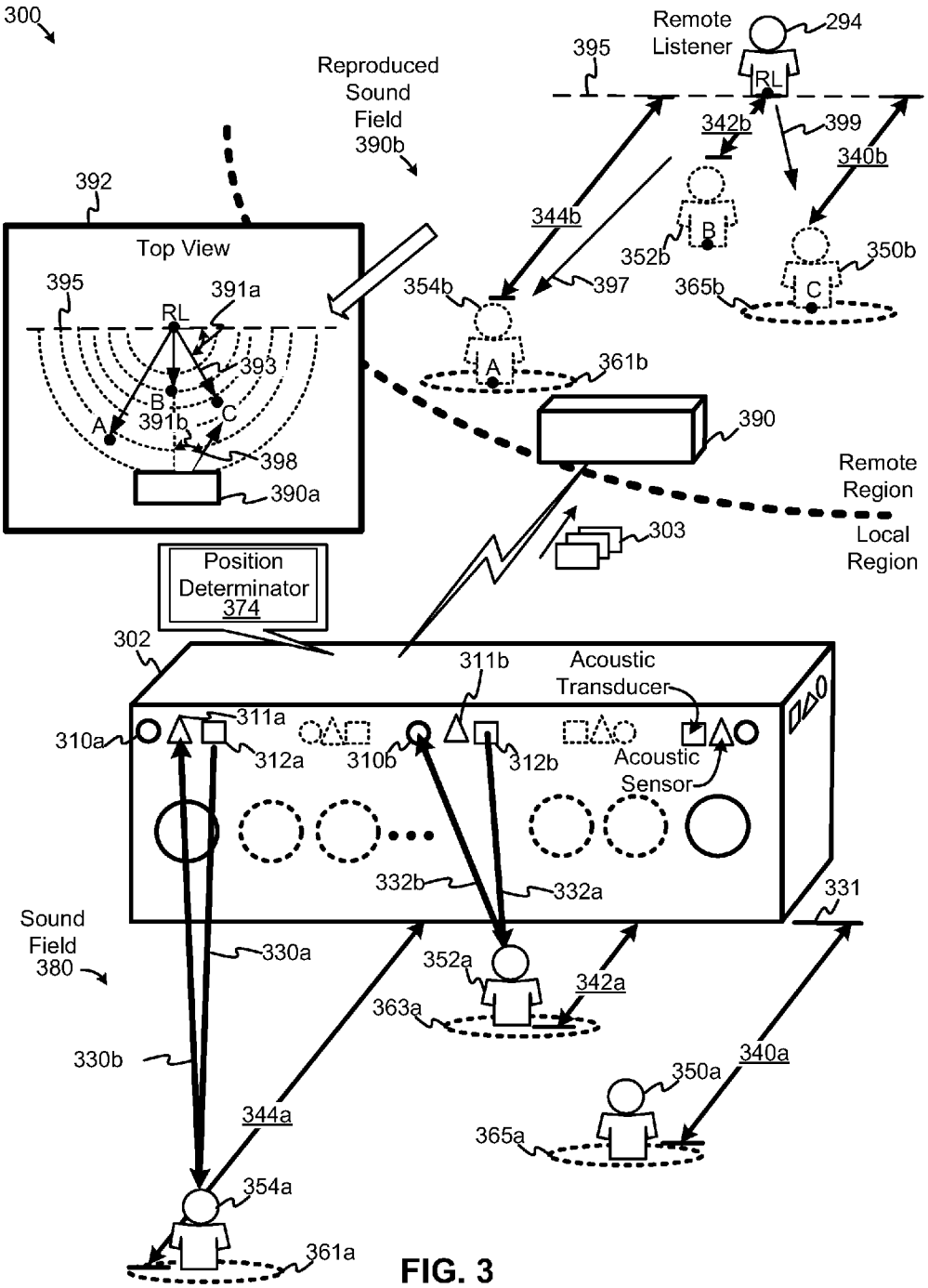
FIG. 3 illustrates an example of a media device configured to determine positions acoustically to facilitate spatial audio generation and/or reproduction, according to some embodiments.

FIG. 3 illustrates an example of a media device configured to determine positions acoustically to facilitate spatial audio generation and/or reproduction, according to some embodiments. Diagram 300 depicts a media device 302 including a position determinator 374, one or more microphones 310, one or more acoustic transducers 312 and one or more acoustic sensors 311. Acoustic transducers 312 are configured to generate acoustic probe signals configured to detect objects or entities, such as audio sources, in sound field 380. Acoustic sensors 311 are configured to receive the reflected acoustic probe signals for determining the distance between the entity that caused reflection of the acoustic probe signal back to media device 302. Position determinator 374 is configured to determine the direction and/or distance of such an entity to calculate, for example, a position of listener 354*a* and/or audio space 361*a*.

To illustrate, consider that acoustic transducer 312*a* generates an acoustic probe signal 330*a* to probe the distance to an entity, such as listener 354*a*. Reflected acoustic probe signal 330*b* (or a portion thereof) returns, or substantially returns, toward acoustic transducer 312*a* where it is received by, for example, acoustic sensor 311*a*. Position determinator 374 determines the distance 344*a* to audio space 361*a* (e.g., relative to line 331 coincident with the face of media device 302) based on, for example, the time delay between transmission of acoustic probe signal 330*a* and reception of reflected acoustic probe signal 330*b*.

According to another example, one or more microphones 210 can provide a dual function of receiving audio and reflected acoustic probe signals. Thus, in this example, acoustic sensor 311*b* is optional and may be omitted. To illustrate, consider that acoustic transducer 312*b* generates an acoustic probe signal 332*a* to probe the distance to an entity, such as listener 352*a*. Reflected acoustic probe signal 332*b* (or a portion thereof) returns or substantially returns toward acoustic transducer 312*b* where it can be received by, for example, microphone 310*b*. Position determinator 374 determines the distance 342*a* to audio space 363*a* based on, for example, the time delay between transmission and reception of the acoustic probe signal. Distance 340*a* between media device 302 and audio space 365*a*, which coincides with a position of audio source 350*a*, can be determined using the above-described implementations or other variations thereof.

A spatial audio generator (not shown) of media device 302 is configured to generate spatial audio based on position information calculated by position determinator 374. Data 303 representing spatial audio can be transmitted to remote audio system 390 for generating a reproduced sound field 390*b* for presentation to a remote listener 294. As shown, audio system 390 uses data 303 to form reproduced sound field 390*b* in which remote listener 294 perceives audio generated by audio source 354*a* as originating from a perceived audio source 354*b* in a position in perceived audio space 361*b*. That is, audio source 354*a* is perceived to originate in audio space 361*b* at a distance 344*b* (e.g., in a direction 397 from point RL) relative to, for example, line 395, which coincides with that location of remote listener 294. Similarly, audio system 390 can form reproduced sound field 390*b* in which remote listener 294 perceives audio generated by audio sources 352*a* and 350*a* as originating from perceived audio sources 352*b* and 350*b*, respectively. In particular, remote listener 294 perceives audio source 352*a* in sound field 380 as located at a distance 342*b* from line 395, whereas audio source 350*a* is perceived to originate as audio source 350*b* in audio space 365*b* at a distance 340*b* (e.g., in a direction 399 from point RL). Note that distances 340*b*, 342*b*, and 344*b* can correspond to, for example, a nearest acoustic transducer or sensor relative to one of perceived audio sources 350*b*, 352*b*, and 354*b*. As such, distances can be measured or described relative to point RL or any other point of reference, according to some examples.

View 392 depicts a top view of the perceived positions A, B, and C at which perceived audio sources 354*b*, 352*b*, and 350*b* are respectively disposed relative to point RL coinciding with line 395. For example, audio system 390*a* generates a perceived audio space 365*b* at point C at a distance 398 in a direction based on an angle 391*b* from a line orthogonal to the face of audio system 390*a*. Remote listener 294 at point RL perceives audio source 350*b* at point C in a direction 393 from point RL at a direction determined by an angle 391*a* relative to line 395.

Figure 4:
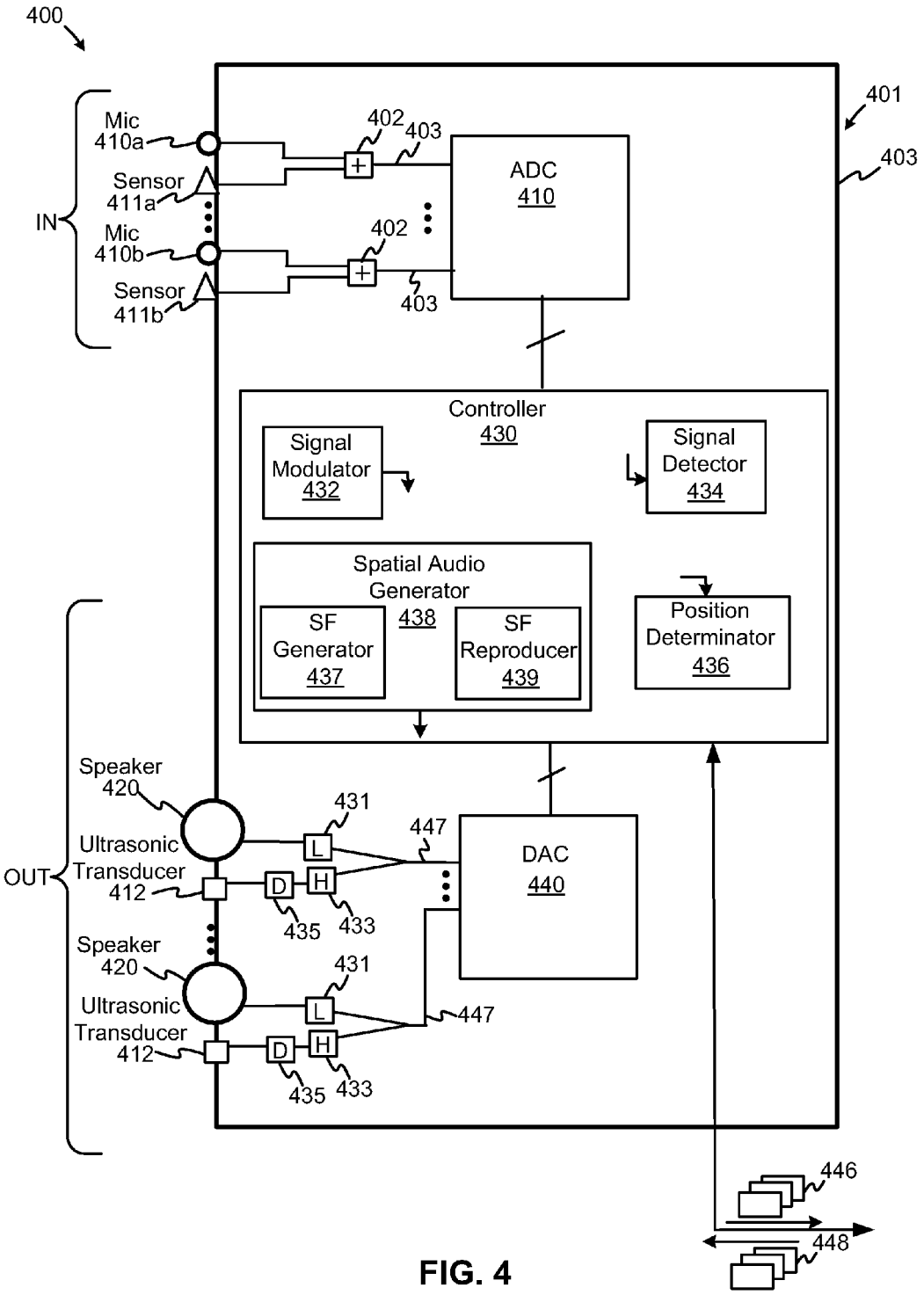
FIG. 4 depicts an example of a media device configured to generate spatial audio based on ultrasonic probe signals, according to some embodiments.

FIG. 4 depicts an example of a media device configured to generate spatial audio based on ultrasonic probe signals, according to some embodiments. Diagram 400 depicts a media device 401 including a housing 403, one or more microphones ("Mic") 410, one or more ultrasonic sensors ("sensor") 411, one or more transducers, such as loudspeakers ("Speaker") 420, and one or more acoustic probe transducers, such as ultrasonic transducers 412. Further, media device 401 includes one or more analog-to-digital circuits ("ADC") 410 coupled to a controller 430, which, in turn, is coupled to one or more digital-to-analog circuits ("DAC") 440. Diagram 400 is intended to depict components schematically in which acoustic signals enter ("IN") media device 401, whereas other components are associated with acoustic signals that exit ("OUT") media device 401. Depicted locations of microphones 410, sensors 411, speakers 420, and transducers 412 are explanation purposes and do not limit their placement in housing 403. Thus, loudspeakers 420 are configured to emit audible acoustic signals into a region external to housing 401, whereas acoustic probe transducers can be configured to emit ultrasonic signals external to housing 401 to detect a distance to one or more audio sources, such as listeners. Controller 430 can be configured to determine a position of at least one audio source, such as a listener, in a sound field, based on one or more reflected acoustic probe signals received by one or more ultrasonic sensors 411.

In some embodiments, acoustic signals entering multiple microphones and multiple ultrasonic sensors can be combined onto channels for feeding such signals into various analog-to-digital circuits 410. Microphones 410 may be band-limited below a range of ultrasonic frequencies, whereas ultrasonic sensors 411 may be band-limited above a range of acoustic frequencies. The acoustic signals for microphone 410*a* and sensor 411*b* can be combined (e.g., shown conceptually as summed 402 together) onto a common channel 403, which is fed into at least one A/D circuit 410. In at least one embodiment, one or more microphones 410 can be configured to receive audio from one or more audio sources, whereby the audio from at least one microphone 410 and a received ultrasonic signal from at least one sensor 411 can be propagated via at least a common portion 403 of a path to controller 430.

Further to diagram 400, at least one speaker 420 shares a common portion 447 of the path from controller 430 with at least one ultrasonic transducer 412. As shown, audible and ultrasonic signals can propagate via a shared path portion 447 from one or more digital-to-analog circuits 440. One or more low pass filters ("L") 431 can be coupled between path portion 447 and speaker 420 to facilitate passage of audible acoustic signals for propagation out from speaker 420. By contrast, one or more high pass filters ("H") 433 can be coupled between path portion 447 and ultrasonic transducer 412 to facilitate passage of ultrasonic acoustic signals for propagation out from ultrasonic transducer 412. As shown, ultrasonic transducer 412 can be driven by driver ("D") 435, which can be configured to maintain an acoustic probe transducer, such as an ultrasonic transducer 412, at an approximate maximum displacement during a shift from a first characteristic (e.g., a first phase) to a second characteristic (e.g., second phase). In some embodiments, ultrasonic transducer 412 is a piezoelectric transducer.

As shown further in diagram 400, controller 430 includes a signal modulator 432, a signal detector 434, a spatial audio generator 438, and a position determinator 436. Signal modulator 432 is configured to modulate one or more ultrasonic signals to form multiple acoustic probe signals for probing distances to one or more audio sources and/or entities in a sound field. In some embodiments, signal modulator 432 is configured to generate unique modulated ultrasonic signals for transmission from different ultrasonic transducers 412. Since each unique modulated ultrasonic signal is transmitted from a specific corresponding ultrasonic transducer 412, a direction of transmission of the unique modulated ultrasonic signal is known based on, for example, the orientation of ultrasonic transducer 412. With a direction generally known, the delay in receiving the reflected unique modulated ultrasonic signal provides a basis from which to determine a distance. Signal detector 434 is configured to identify one or more reflected modulated ultrasonic signals received into one or more sensors 411. In some embodiments, signal detector 434 is configured to monitor multiple modulated ultrasonic signals (e.g., concurrently) to isolate different temporal and spatial responses to facilitate determination of one or more positions of one or more audio sources.

Position determinator 436 can be configured to determine a position of an audio source and/or an entity in the sound field by, for example, first detecting a particular modulated ultrasonic signal having a particular direction, and then calculating a distance to the audio source or entity based on calculated delay. Spatial audio generator 438 is configured to generate spatial audio based on audio received from microphones 410 for transmission as audio data 446, which is destined for presentation at a remote audio system. Further, spatial audio generator 438 can receive audio data 448 from a remote location that represent spatial audio for presentation to a local sound field. As such, spatial audio can be transmitted via speakers 420 (e.g., arrays of transducers, such as those formed in a phase-arrayed transducer arrangements) to generate sound beams for creating spatial audio and one or more audio spaces. In some examples, spatial audio generator 438 may optionally include a sound field ("SF") generator 437 and/or a sound field ("SF") reproducer 439. Sound field generator 437 can generate spatial audio based on audio received from microphones 410, whereby the spatial audio is transmitted as audio data 446 to a remote location. Sound field reproducer 439 can receive audio data 448, which can include control data (e.g., including spatial filter parameters), for converting audio received from a remote location into spatial audio for transmission through speakers 420 to local listeners. Regardless, audio data representing spatial audio originating from remote location can be combined at controller 430 with modulated ultrasonic signals for transmission over at least a portion 447 of a common, shared path.

In view of the foregoing, the functions and/or structures of media device 401, as well as its components, can facilitate the determination of positions of audio sources (e.g., listeners) using acoustic techniques, thereby effectively employing acoustic-related components for both audible signals and ultrasonic signals. In particular, the use of components for multiple functions can preserve resources (as well as energy consumption) that otherwise might be needed to determine positions by other means, such as by using video or image capture devices along with audio presentation devices. Such image capture devices are typically disparate in structure and function than that of audio devices.

Further, acoustic probe signals and reflected acoustic probe signals, such as ultrasonic signals, can be multiplexed into common channels into analog-to-digital circuits or out from digital-to-analog circuits, thereby providing for common paths over which audible and ultrasonic signal traverse. The use of common paths (or path portions), as well as common hardware and/or software, such as digital signal processing structures, provides for inherent synchronization of acoustic signals whether they be composed of audible audio or ultrasonic audio. Thus, additional synchronization need not be required. Moreover, spatial and temporal resolution can be enhanced for at least the above reasons, as well as the use of a driver 435 that is configured to maintain an acoustic probe transducer, such as an ultrasonic transducer 412, at an approximate maximum displacement (e.g., at or near a maximum excursion of a driver) during a shift from a first characteristic, such as a first phase, to a second characteristic, such as a second phase, thereby preserving energy that otherwise might be dissipated in changing phases at inopportune times.

In some embodiments, media device 401 can be in communication (e.g., wired or wirelessly) with a mobile device, such as a mobile phone or computing device. In some cases, such a mobile device, or any networked computing device (not shown) in communication with media device 401, can provide at least some of the structures and/or functions of any of the features described herein. As depicted in FIG. 4 and subsequent figures (or preceding figures), the structures and/or functions of any of the above-described features can be implemented in software, hardware, firmware, circuitry, or any combination thereof. Note that the structures and constituent elements above, as well as their functionality, may be aggregated or combined with one or more other structures or elements. Alternatively, the elements and their functionality may be subdivided into constituent sub-elements, if any. As software, at least some of the above-described techniques may be implemented using various types of programming or formatting languages, frameworks, syntax, applications, protocols, objects, or techniques. For example, at least one of the elements depicted in FIG. 4 (or any figure) can represent one or more algorithms. Or, at least one of the elements can represent a portion of logic including a portion of hardware configured to provide constituent structures and/or functionalities.

For example, controller 430 and any of its one or more components, such as signal modulator 432, signal detector 434, spatial audio generator 438, and position determinator 436, can be implemented in one or more computing devices (i.e., any audio-producing device, such as desktop audio system (e.g., a Jambox® or a variant thereof), mobile computing device, such as a wearable device or mobile phone (whether worn or carried), that include one or more processors configured to execute one or more algorithms in memory. Thus, at least some of the elements in FIG. 4 (or any figure) can represent one or more algorithms. Or, at least one of the elements can represent a portion of logic including a portion of hardware configured to provide constituent structures and/or functionalities. These can be varied and are not limited to the examples or descriptions provided.

As hardware and/or firmware, the above-described structures and techniques can be implemented using various types of programming or integrated circuit design languages, including hardware description languages, such as any register transfer language ("RTL") configured to design field-programmable gate arrays ("FPGAs"), application-specific integrated circuits ("ASICs"), multi-chip modules, or any other type of integrated circuit. For example, controller 430 and any of its one or more components, such as signal modulator 432, signal detector 434, spatial audio generator 438, and position determinator 436, can be implemented in one or more computing devices that include one or more circuits. Thus, at least one of the elements in FIG. 4 (or any figure) can represent one or more components of hardware. Or, at least one of the elements can represent a portion of logic including a portion of circuit configured to provide constituent structures and/or functionalities.

According to some embodiments, the term "circuit" can refer, for example, to any system including a number of components through which current flows to perform one or more functions, the components including discrete and complex components. Examples of discrete components include transistors, resistors, capacitors, inductors, diodes, and the like, and examples of complex components include memory, processors, analog circuits, digital circuits, and the like, including field-programmable gate arrays ("FPGAs"), application-specific integrated circuits ("ASICs"). Therefore, a circuit can include a system of electronic components and logic components (e.g., logic configured to execute instructions, such that a group of executable instructions of an algorithm, for example, and, thus, is a component of a circuit). According to some embodiments, the term "module" can refer, for example, to an algorithm or a portion thereof, and/or logic implemented in either hardware circuitry or software, or a combination thereof (i.e., a module can be implemented as a circuit). In some embodiments, algorithms and/or the memory in which the algorithms are stored are "components" of a circuit. Thus, the term "circuit" can also refer, for example, to a system of components, including algorithms. These can be varied and are not limited to the examples or descriptions provided.

Figure 5A:
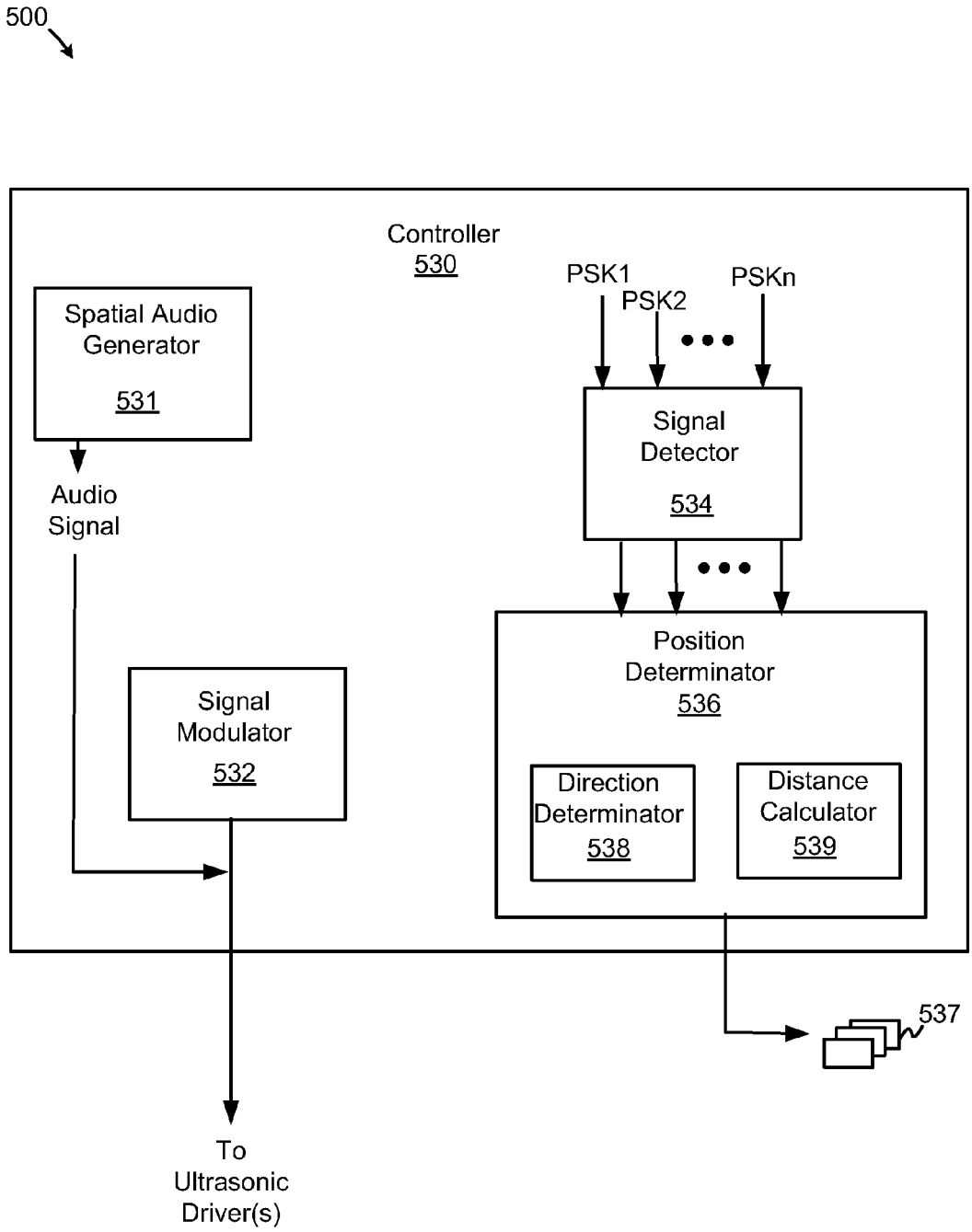
FIG. 5A depicts a controller including a signal modulator operable to generate pseudo-random key-based signals, according to some embodiments.

FIG. 5A depicts a controller including a signal modulator operable to generate pseudo-random key-based signals, according to some embodiments. Controller 530 is shown to include a spatial audio generator 531, a signal modulator 532, a signal detector 534, and a position determinator 536. In some embodiments, spatial audio generator 531 provides data representing spatial audio for combination with one or more modulated ultrasonic signals generated by signal modulator 532. In some embodiments, signal modulator 532 is configured to generate phase-shifted key ("PSK") signals modulated with unique pseudo-random sequences for one or more individual PSK signals transmitted for a corresponding ultrasonic transducer. Thus, signal modulator 532 can generate unique ultrasonic signals, with at least one unique ultrasonic signal being generated for emission from a corresponding acoustic probe transducer. In some examples, the unique ultrasonic signal is emitted in a direction associated with an orientation of an acoustic probe transducer. The orientation can form a basis from which to determine a direction.

Ultrasonic sensors can sense reflected modulated ultrasonic signals from one or more surfaces, a subset of the surfaces being associated with an audio source (e.g., a listener). The reflected unique pseudo-random sequences for one or more individual PSK signals, depicted as "PSK1," "PSK2," . . . , and "PSKn," can be received from the ultrasonic sensors and provided to signal detector 534. In some examples, signal detector 534 can be tuned (e.g., variably tuned) to different pseudo-random sequences to provide multiple detection of different pseudo-random sequences, wherein the detection of pseudo-random sequences of PSK1, PSK2, and PSKn can be in parallel (or in some cases, in series). In some embodiments, signal detector 534 can be configured to operate to multiply received signals by an expected pseudo-random sequence PSK signal. An expected pseudo-random sequence for a PSK signal multiplied with different pseudo-random phase-shift keyed sequences generate waveforms with an average of zero, thereby making the signal essentially zero. However, multiplying the expected pseudo-random sequence PSK signal by reflected version of itself (e.g., a positive ("+") value multiplied by a positive ("+") value, or a negative ("−") value multiplied by a negative ("−") value) generates a relatively stronger response signal, whereby the average value is non-zero, or is substantially non-zero. As such, signal detector 534 may multiply one or more received waveforms by an expected pseudo random sequence PSK to strongly isolate the waveform sought.

Position determinator 536 includes a direction determinator 538 and distance calculator 539. In some examples, direction determinator 538 may be configured to determine a direction associated with a particular received PSK signal. For example, a specific pseudo-random sequence PSK signal can originate from a predetermined acoustic probe transducer having a specific orientation. Thus, when a pseudo-random sequence for a PSK signal is identified, the corresponding direction can be determined. Distance calculator 539 can be configured to calculate a distance to an object that caused reflection of a pseudo-random sequence PSK signal. In some examples, a reflection from a distant surface may be equivalent to a delay of the pseudo-random sequence. Thus, a delay in the multiplied waveform, when compared to the expected transmitted pseudo-random sequence PSK signal, can be equivalent to isolating reflections at a particular range. Multiple instances of such multiplications can be performed in parallel. As such, reflections can be detected at multiple distances in parallel. For example, multiplications can occur at expected delays at incremental distances (e.g., every 6 or 12 inches). A non-zero result determined at a particular delay indicates the range (e.g., 5 feet, 6 inches) from a media device. Note, too, that echoes not at a selected range increment may become invisible or attenuated, thereby improving the response for the specific one or more ranges selected. This can improve spatial and temporal resolutions. According to some examples, spatially-separated ultrasonic sensors can provide a slight time difference in the received signal, and, thus can provide orientation information in addition to distance information. Based on the determined direction and distances, position determinator 536 can determine a distance, for example, from a point in space incident with a local audio system to the audio source based on a sensed reflected ultrasonic signal from surfaces associated with an audio source. This information can transmitted as audio data 537, which can be used to generate a reproduced sound field to reproduce spatial audio at a remote location (or a local location). In some embodiments, the functionality of position determinator can be combined with that of signal detector 534.

Figure 5B:
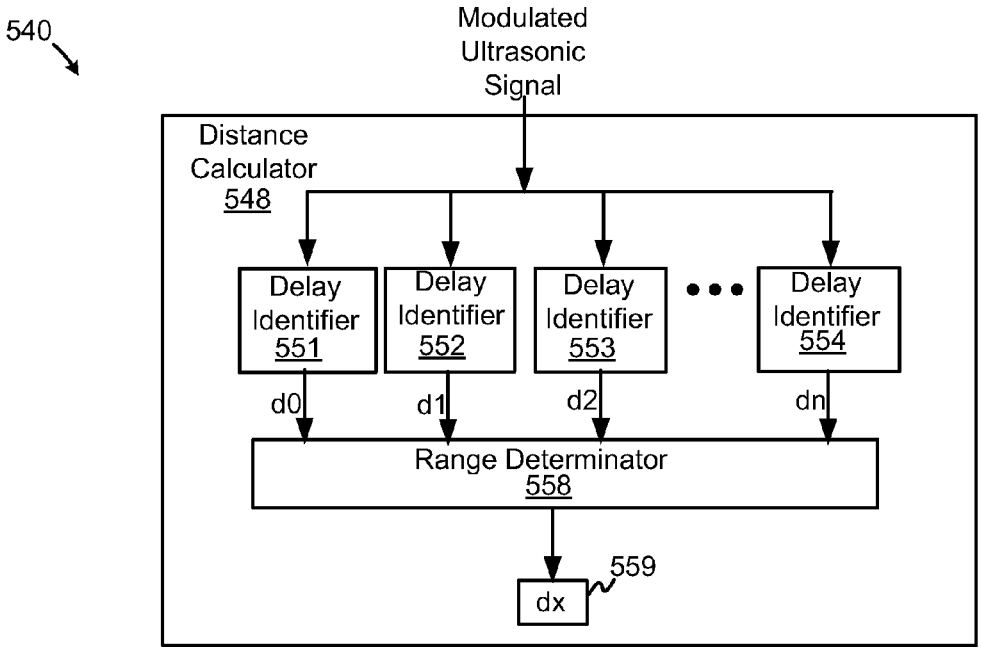
FIG. 5B depicts an example of a distance calculator, according to some embodiments.

FIG. 5B depicts an example of a distance calculator 548, according to some embodiments. As shown in diagram 540, a modulated ultrasonic signal that is reflected and received into an ultrasonic sensor can be provided to a number of delay identifiers 551 to 554, each of which is configured to perform a multiplication at a particular identified delay (e.g., d0, d1, d2, and dn). Such multiplications can occur in parallel, or substantially in parallel. A non-zero result indicates that a delay has been identified, and range determinator 558 determines an associated range or distance associated with the delay. The calculated range is yield as range ("dx") 559.

Figure 5C:
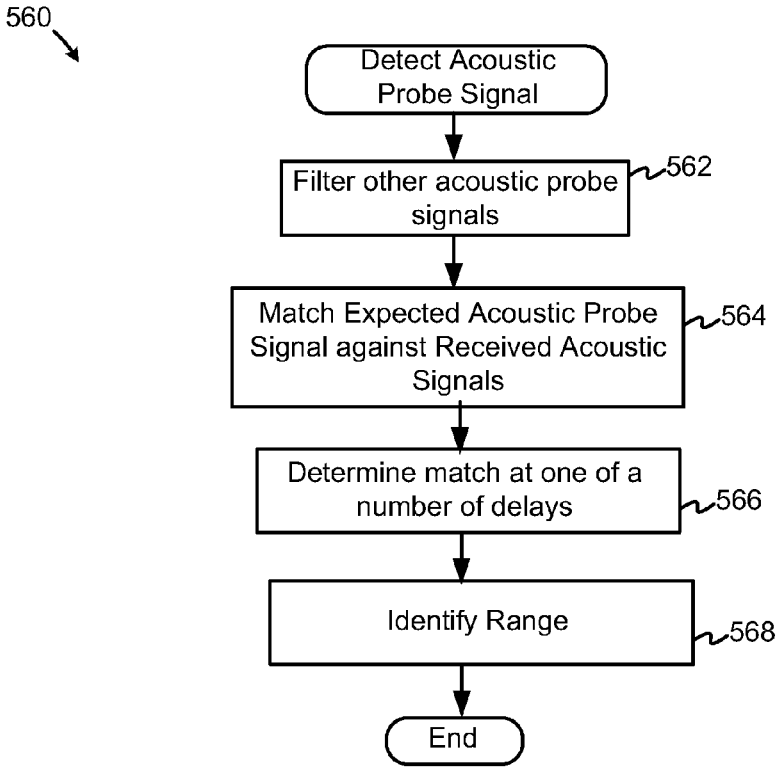
FIG. 5C is an example of a flow by which a reflected acoustic probe signal is detected, according to some embodiments.

FIG. 5C is an example of a flow by which a reflected acoustic probe signal is detected, according to some embodiments. Flow 560 filters other acoustic probe signals at 562, for example, by determining multiplication results in which the averages of such multiplication are zero, or substantially zero. At 564, a unique modulated acoustic probe signal (e.g., an expected pseudo-random sequence PSK signal) can be matched against sensed reflected modulated acoustic signals to determine a match at one of a number of delays at 566. At 568, a range is determined based on the matched delay.

Figure 6:
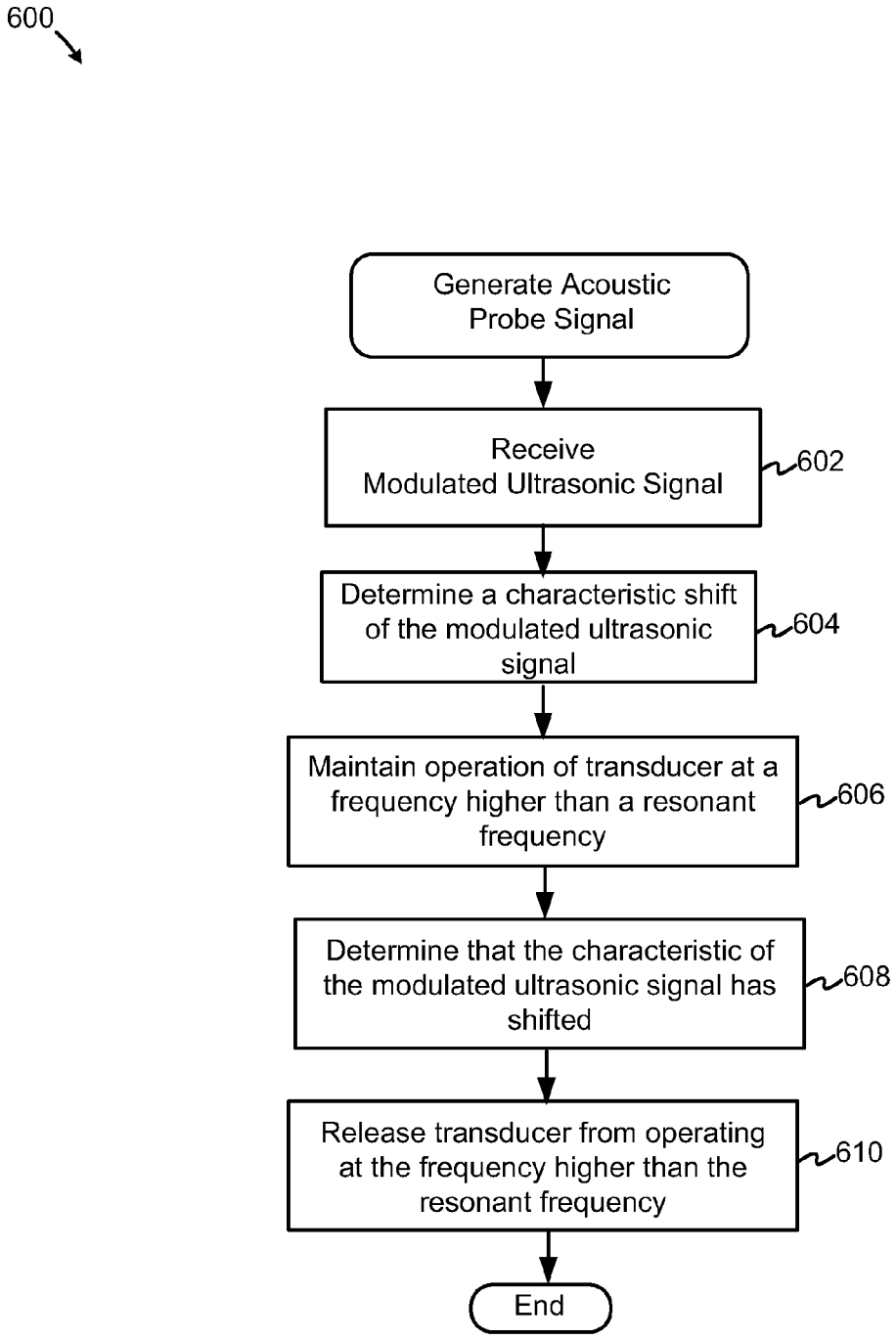
FIG. 6 is an example of a flow for driving an ultrasonic transducer, according to some examples.

FIG. 6 is an example of a flow for driving an ultrasonic transducer, according to some examples. At 602, a modulated ultrasonic signal is received from, for example, a controller configured to include a signal modulator. The modulated ultrasonic signal can be a pseudo-random sequence PSK signal. At 604, a characteristic shift of the modulated ultrasonic signal is determined. For example, in phase-shift key modulation, a change in phase may be determined to occur or soon to occur. At 606, operation of an acoustic ultrasonic transducer, such as a piezoelectric transducer, can be maintained at a frequency higher than a resonant frequency. In this way, the piezoelectric transducer can be prevented from moving away from a maximum displacement or excursion (or near maximum displacement or excursion) until the phase shift occurs, thereby retaining substantially all or most of the energy and to achieve a relatively rapid phase shift. While the piezoelectric transducer is held, it can resonate at higher-order modes consistent with, for example, a null. Once it is determined at 608 that the characteristic has shifted (e.g., a phase has shifted), the piezoelectric transducer can be released at 610 from operating at the frequency that is higher than the resonant frequency to resume normal driving operation.

Figure 7:
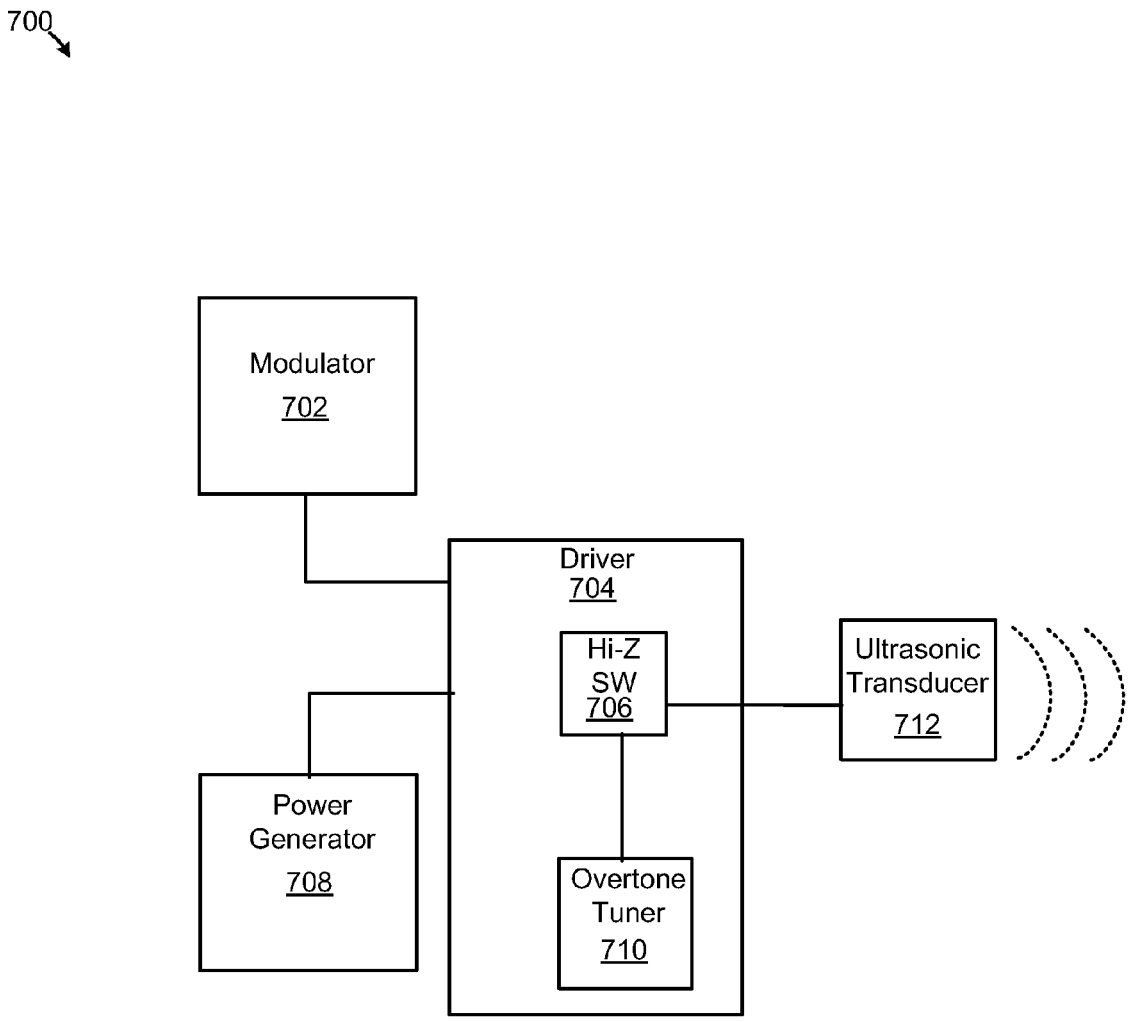
FIG. 7 depicts a driver for driving acoustic probe transducers, according to some embodiments.

FIG. 7 depicts a driver for driving acoustic probe transducers, according to some embodiments. Diagram 700 depicts a driver 704 including a high-impedance switch ("SW") 706 and an overtone tuner 710, whereby driver 704 is configured to drive ultrasonic transducer 712. Driver 704 receives a modulated ultrasonic signal from a modulator 702, which can be a pseudo-random sequence PSK signal generator. Thus, driver 704 can be configured as a push-pull driver driven by a baseband phase-shift-keyed pulse where phase shifts can be timed to occur at a limit of excursion of driver 704 (e.g., when current is substantially zero or is zero, and voltage is at or near a maximum). Driver 704 also can receive power from a power generator 708, which can be a DC power converter. In operation, high-impedance switch 706 is configured to operate during the phase-shift period to prevent current dissipation by maintaining the transducer in a state that prevents it from moving from a maximum displacement. Overtone tuner 710 is configured to resonate the ultrasonic transducer 712 at frequencies higher than the resonant frequency when high-impedance switch 706 is activated. In some examples, overtone turner 710 can be implemented as a capacitor. In various embodiments, high-impedance switch 706 and overtone turner 710 can enhance phase-shift-key responses in terms of spatial and temporal resolutions. By using a tuning capacitor, the resonance is at, for example, a first overtone, thereby providing a well-defined response equivalent to a frequency shift during the phase-inversion, which is equivalent to frequency-shift keying ("FSK"). This may ensure that the phase inversion can be detected and filtered, and also, when averaged over a cycle of a harmonic, the average becomes zero.

Figure 8A:
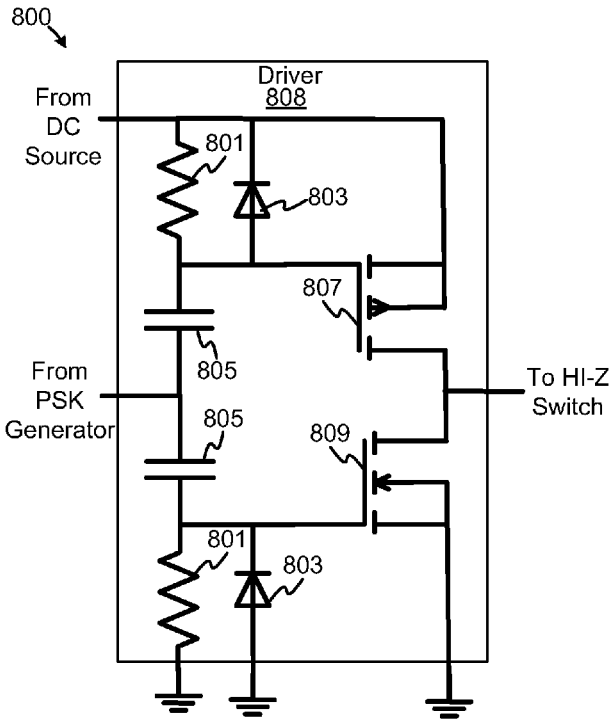
FIGS. 8A to 8D are diagrams depicting examples of various components of an acoustic probe transducer, according to some embodiments.
Figure 8B:
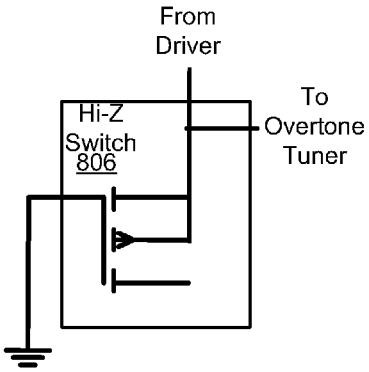
Figure 8C:
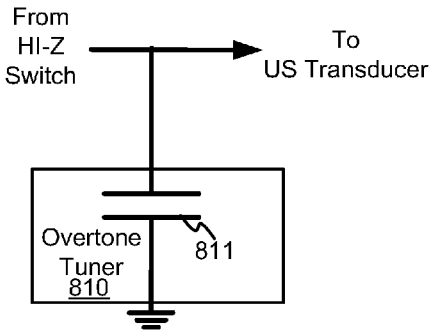
Figure 8D:
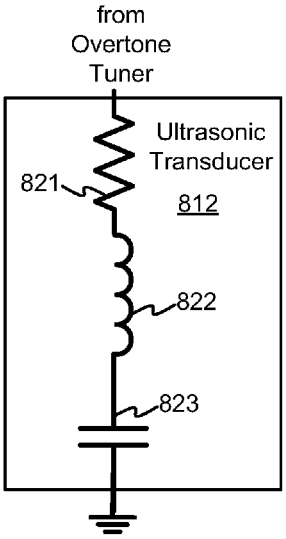

FIGS. 8A to 8D are diagrams depicting examples of various components of an acoustic probe transducer, according to some embodiments. Diagram 800 of FIG. 8A is a driver 808 including resistors 801, capacitors 805, diodes 803, transistor 807 and transistor 809. FIG. 8B depicts an example of a high-impedance switch 806. FIG. 8C depicts an example of an overtone tuner 810 as a capacitor 811. FIG. 8D is a model of a piezoelectric transducer 812 that includes a resistance 821, an inductance 822 and a capacitance 823.

Figure 9:
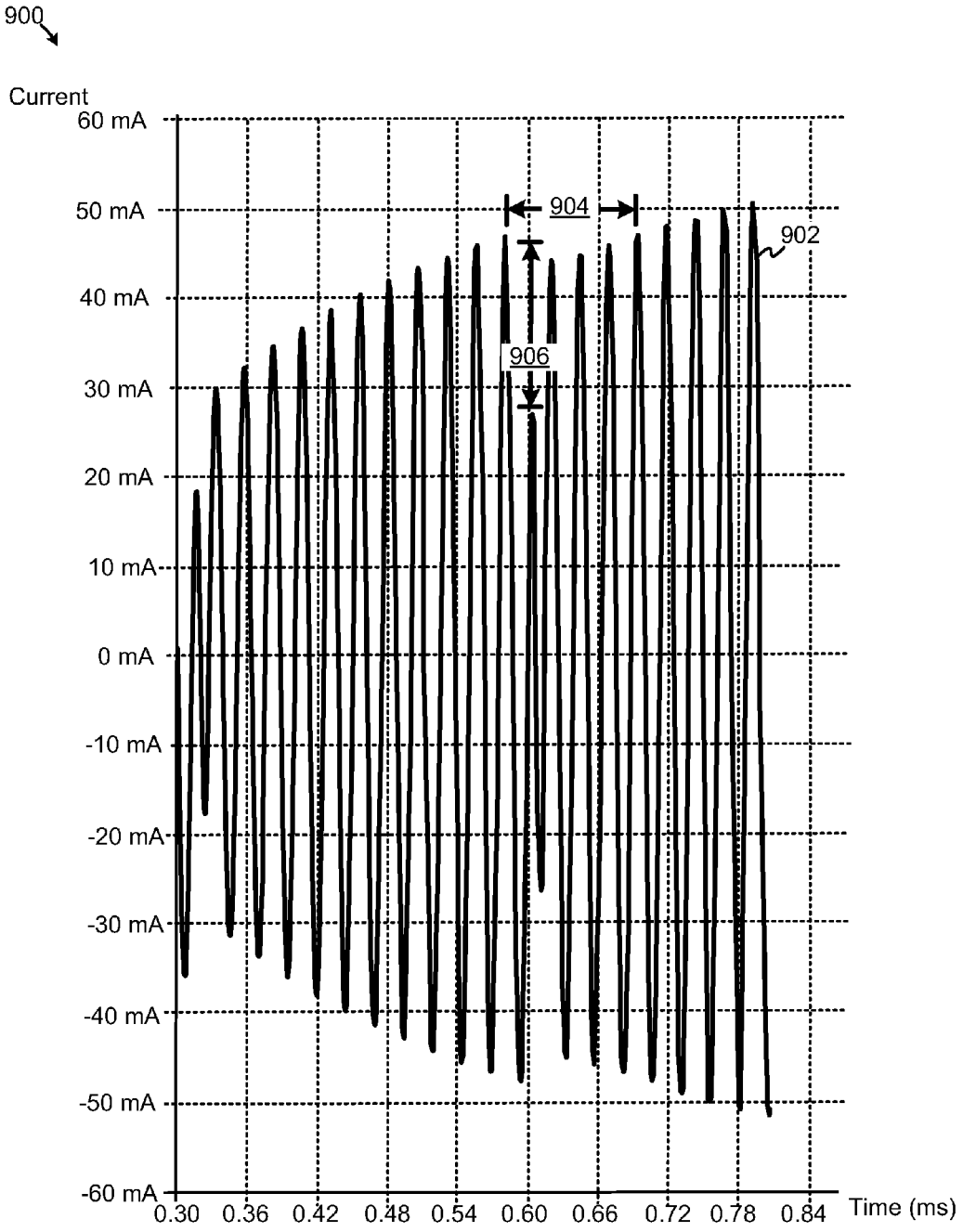
FIG. 9 depicts an example of a conventional range-finding technique implementing an example of a driver, according to various examples.

FIG. 9 depicts an example of a conventional range-finding technique implementing an example of a driver, according to various examples. Consider that diagram 900 illustrates a current for driving an ultrasonic transducer for purposes of range-finding. As shown, generating a drive current 902 includes switching, for example, from one signal characteristic, such as a first phase, to another signal characteristic, such as a second phase, during a phase-shift period 904. At shown, current 902 can vary by a magnitude 906, at least in some examples, which is orders of magnitude less than otherwise might be the case. Switching of driver 704 of FIG. 7, therefore, removes or otherwise reduces temporal delays and provides for relatively rapid switching to enhance at least temporal resolutions.

Figure 10:
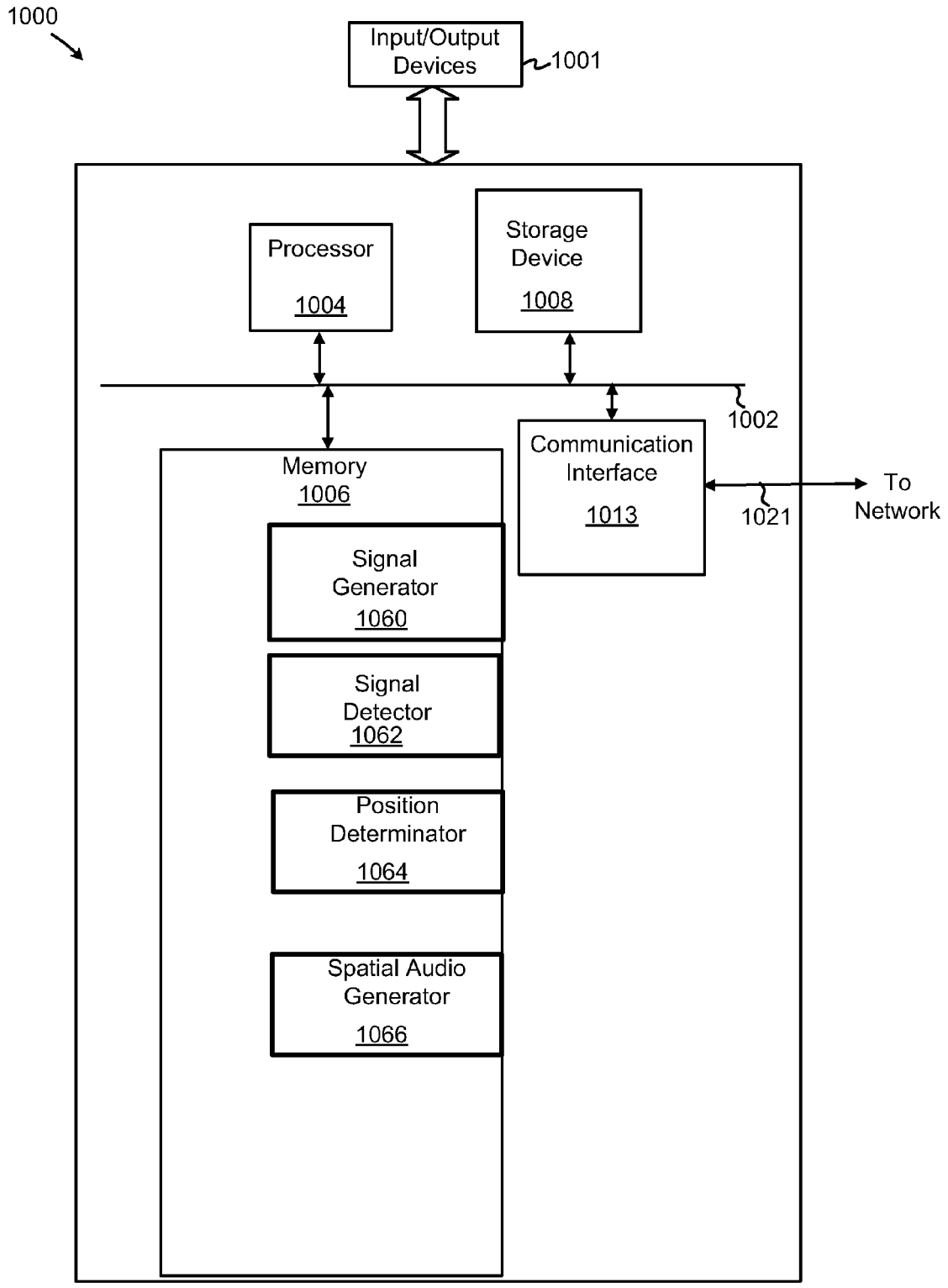
FIG. 10 illustrates an exemplary computing platform disposed in a media device in accordance with various embodiments.

FIG. 10 illustrates an exemplary computing platform disposed in a media device in accordance with various embodiments. In some examples, computing platform 1000 may be used to implement computer programs, applications, methods, processes, algorithms, or other software to perform the above-described techniques. Computing platform 1000 includes a bus 1002 or other communication mechanism for communicating information, which interconnects subsystems and devices, such as processor 1004, system memory 1006 (e.g., RAM, etc.), storage device 1008 (e.g., ROM, etc.), a communication interface 1013 (e.g., an Ethernet or wireless controller, a Bluetooth controller, etc.) to facilitate communications via a port on communication link 1021 to communicate, for example, with a computing device, including mobile computing and/or communication devices with processors. Processor 1004 can be implemented with one or more central processing units ("CPUs"), such as those manufactured by Intel® Corporation, or one or more virtual processors, as well as any combination of CPUs and virtual processors. Computing platform 1000 exchanges data representing inputs and outputs via input-and-output devices 1001, including, but not limited to, keyboards, mice, audio inputs (e.g., speech-to-text devices), user interfaces, displays, monitors, cursors, touch-sensitive displays, LCD or LED displays, and other I/O-related devices.

According to some examples, computing platform 1000 performs specific operations by processor 1004 executing one or more sequences of one or more instructions stored in system memory 1006, and computing platform 1000 can be implemented in a client-server arrangement, peer-to-peer arrangement, or as any mobile computing device, including smart phones and the like. Such instructions or data may be read into system memory 1006 from another computer readable medium, such as storage device 1008. In some examples, hard-wired circuitry may be used in place of or in combination with software instructions for implementation. Instructions may be embedded in software or firmware. The term "computer readable medium" refers to any tangible medium that participates in providing instructions to processor 1004 for execution. Such a medium may take many forms, including but not limited to, non-volatile media and volatile media. Non-volatile media includes, for example, optical or magnetic disks and the like. Volatile media includes dynamic memory, such as system memory 1006.

Common forms of computer readable media includes, for example, floppy disk, flexible disk, hard disk, magnetic tape, any other magnetic medium, CD-ROM, any other optical medium, punch cards, paper tape, any other physical medium with patterns of holes, RAM, PROM, EPROM, FLASH-EPROM, any other memory chip or cartridge, or any other medium from which a computer can read. Instructions may further be transmitted or received using a transmission medium. The term "transmission medium" may include any tangible or intangible medium that is capable of storing, encoding or carrying instructions for execution by the machine, and includes digital or analog communications signals or other intangible medium to facilitate communication of such instructions. Transmission media includes coaxial cables, copper wire, and fiber optics, including wires that comprise bus 1002 for transmitting a computer data signal.

In some examples, execution of the sequences of instructions may be performed by computing platform 1000. According to some examples, computing platform 1000 can be coupled by communication link 1021 (e.g., a wired network, such as LAN, PSTN, or any wireless network) to any other processor to perform the sequence of instructions in coordination with (or asynchronous to) one another. Computing platform 1000 may transmit and receive messages, data, and instructions, including program code (e.g., application code) through communication link 1021 and communication interface 1013. Received program code may be executed by processor 1004 as it is received, and/or stored in memory 1006 or other non-volatile storage for later execution.

In the example shown, system memory 1006 can include various modules that include executable instructions to implement functionalities described herein. In the example shown, system memory 1006 includes a signal generator module 1060 configured to implement signal generation of a modulated acoustic probe signal. Signal detector module 1062, position determinator module 1064, and a spatial audio generator module 1066 each can be configured to provide one or more functions described herein.

Although the foregoing examples have been described in some detail for purposes of clarity of understanding, the above-described inventive techniques are not limited to the details provided. There are many alternative ways of implementing the above-described invention techniques. The disclosed examples are illustrative and not restrictive.

What is claimed:

1. An apparatus comprising:
a housing;
a plurality of transducers disposed in the housing and configured to emit audible acoustic signals into a region external to the housing, the region including one or more audio sources;
a plurality of acoustic probe transducers configured to emit ultrasonic signals, at least a subset of the acoustic probe transducers each is configured to emit a unique ultrasonic signal;
a plurality of acoustic sensors configured to sense received ultrasonic signals reflected from the one or more audio sources;
a controller configured to determine a position of at least one audio source of the one or more audio sources; and
a signal modulator configured to generate the unique ultrasonic signal; and
a driver configured to maintain an acoustic probe transducer at an approximate maximum displacement during a shift from a first characteristic to a second characteristic.

2. The apparatus of claim 1, wherein the signal modulator is a phase-shift key signal modulator configured to shift from a first phase as the first characteristic to a second phase as the second characteristic.

3. The apparatus of claim 1, further comprising:
a driver configured to drive an acoustic probe transducer of the plurality of acoustic sensors;
a high-impedance ("Hi-Z") switch coupled to the driver;
an overtone tuner circuit coupled to the high-impedance switch; and
an ultrasonic transducer as the acoustic probe transducer.

4. The apparatus of claim 3, further comprising:
a phase-shift key signal modulator configured to generate the unique ultrasonic signal as a unique modulated signal,
wherein the high-impedance ("Hi-Z") switch is configured to switch to a high impedance state at a shift in the phase of the unique modulated ultrasonic signal,
wherein the overtone tuner circuit is configured to resonate the ultrasonic transducer at a frequency higher than a resonant frequency.

5. The apparatus of claim 3, wherein the overtone tuner circuit includes a capacitor and the ultrasonic transducer includes a piezoelectric ultrasonic transducer.

6. The apparatus of claim 1, further comprising:
a signal detector configured to detect the unique ultrasonic signal as one of the received ultrasonic signals.

7. The apparatus of claim 6, further comprising:
a position determinator configured to determine the position of the at least one audio source.

8. The apparatus of claim 7, further comprising:

a distance calculator configured to determine a distance between the at least one audio source and a point associated with the housing.

9. The apparatus of claim 6, further comprising:

a plurality of delay identifiers configured to multiply the unique ultrasonic signal against at least one of the received ultrasonic signals, each of the delay identifiers being associated with a specific delay such that a non-zero average produced by one of the plurality of delay identifiers determines a range.

10. The apparatus of claim 9, wherein the plurality of delay identifiers operate substantially in parallel.

11. The apparatus of claim 1, further comprising:

one or more microphones configured to receive audio from the one or more audio sources; and a first path from at least one microphone of the one or more microphones and a subset of acoustic sensors of the plurality of acoustic sensors to the controller, wherein the audio and the received ultrasonic signals are propagated via at least a common portion of the first path to the controller.

12. The apparatus of claim 1, further comprising:

a path from the controller to a subset of transducers of the plurality of transducers and a subset of acoustic probe transducers of the plurality of acoustic probe transducers, wherein a subset of the audible acoustic signals and a subset of the ultrasonic signals are propagated via at least a common portion of the second path to the subset of transducers and the subset of acoustic probe transducers, respectively.

13. The apparatus of claim 12, further comprising:

one or more low pass filters coupled to the common portion of the second path, the one or more low pass filters being configured to provide the subset of the audible acoustic signals to the subset of transducers; and one or more high pass filters coupled to the common portion of the second path, the one or more high pass filters being configured to provide the subset of the ultrasonic signals to the subset of acoustic probe transducers.

14. The apparatus of claim 13, wherein the subset of transducers comprises:

loudspeakers.

15. A method comprising:

generating unique ultrasonic signals, at least a unique ultrasonic signal being generated for emission from corresponding an acoustic probe transducer;

emitting the unique ultrasonic signal in a direction associated with an orientation of the acoustic probe transducer;

sensing reflected ultrasonic signals from one or more surfaces, a subset of surfaces being associated with an audio source;

determining a distance from a point in space incident with a local audio system to the audio source based on a sensed reflected ultrasonic signal from the subset of surfaces being associated with the audio source;

identifying a position of the audio source relative to the point m space as a function of the distance to the audio source;

transmitting data representing audio to a remote audio system at a remote location to reproduce the audio as spatially originating from the position of the audio source relative to the remote audio system;

filtering other reflected ultrasonic signals;

matching data representing the unique ultrasonic signal against the sensed reflected ultrasonic signals;

determining a match associated with a delay; and identifying a range based on the delay.

16. The method of claim 15, wherein matching the data representing the unque ultarasonic signal against the sensed reflected ultrasonic signals comprises: multiplying the sensed reflected ultrasonic signals with the unique ultrasonic signal at different amounts of delay; filtering results of each multiplication associated with substantially zero; and identifying the match associated with a non-zero result of at least one of the multiplications.

17. The method of claim 15, wherein emitting the unique ultrasonic signal comprises:

determining a characteristic shift of the unique ultrasonic signal;

maintaining operation of the acoustic probe transducer at an approximate maximum displacement;

determining the characteristic has shifted; and releasing operation of the acoustic probe transducer.

18. The method of claim 15, further comprising:

receiving the audio from the audio source;

transmitting the audio and the sensed reflected ultrasonic signal received at a microphone via a single path portion to a controller; and transmitting audible acoustic signals and the unique ultrasonic signal from the controller via another single path portion to a subset of loudspeakers and the acoustic probe transducer, respectively.

* * * * *